United States Patent [19]

Norden et al.

[11] 4,296,885

[45] Oct. 27, 1981

[54] PROCEDURE FOR THE CAREFUL APPLICATION OF LIQUIDS TO PLANTS IN AGRICULTURAL STANDS

[75] Inventors: Jürgen Norden, Bochum; Bruno Ucinhazska, Dülmen, both of Fed. Rep. of Germany

[73] Assignee: Ruhr-Stickstoff Aktiengesellschaft, Bochum, Fed. Rep. of Germany

[21] Appl. No.: 103,542

[22] Filed: Dec. 13, 1979

[30] Foreign Application Priority Data

Dec. 13, 1978 [DE] Fed. Rep. of Germany ..... 2853773

[51] Int. Cl.[3] ..... A01C 23/00

[52] U.S. Cl. ..... 239/1; 239/159; 239/172

[58] Field of Search ..... 239/146, 164, 165, 167, 239/168, 565, 717, 159, 172; 111/1, 6, 7; 47/1.44, 1.7; 138/40, 110, DIG. 8; 239/1

[56] References Cited

U.S. PATENT DOCUMENTS

| | | | |
|---|---|---|---|
| 260,761 | 7/1882 | Lynch | 239/164 X |
| 1,347,892 | 7/1920 | Christiansen | 239/164 |
| 1,583,619 | 5/1926 | Splittstoser | 239/168 |
| 2,249,130 | 7/1941 | Gunther | 239/164 X |
| 2,364,602 | 12/1944 | Comer et al. | 138/40 |
| 3,179,442 | 4/1965 | Lofgren | 138/110 X |

FOREIGN PATENT DOCUMENTS

| | | | |
|---|---|---|---|
| 99439 | 8/1964 | Denmark | 239/172 |

*Primary Examiner*—Andres Kashnikow

*Attorney, Agent, or Firm*—Oblon, Fisher, Spivak, McClelland & Maier

[57] ABSTRACT

A method and apparatus for applying liquid such as plant protection and pest control liquids or liquid fertilizers to plants in agricultural stands are disclosed. In order to properly meter the flow of liquid onto the plants, metering devices are positioned in distributing members located between the field spray liquid source and the drag hoses which apply the liquid to the plants. The metering devices are preferably grooved discs. The method and apparatus are preferably usable with grains, pasture plants and rape.

18 Claims, 1 Drawing Figure

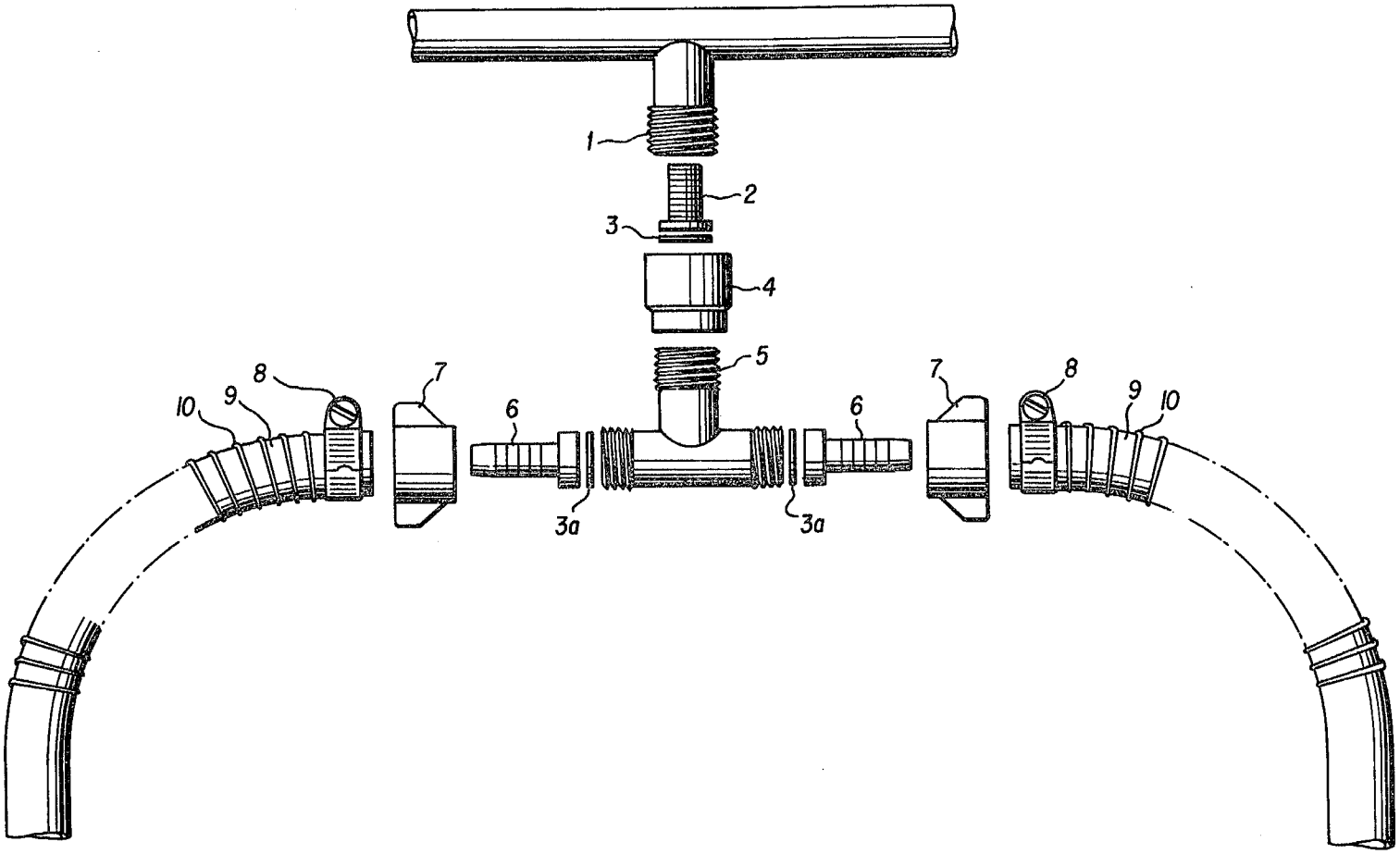
1
2
3
4
5
6
3a
3a
6
7
7
8
9
10
8
9
10

PROCEDURE FOR THE CAREFUL APPLICATION OF LIQUIDS TO PLANTS IN AGRICULTURAL STANDS

BACKGROUND OF THE INVENTION

1. Field of the Invention

The invention relates to a method and device for the application of liquids to plants in agricultural stands with the aid of portable field-spray equipment by the utilization of drag hoses at the distributor elements attached to the regular connection pieces of application equipment.

2. Description of the Prior Art

In agriculture in general, the application of fertilizers and the metering of plant protection and pest control is performed not only prior, simultaneously with, or shortly after the sowing, but it is also done during advanced stages of vegetation. The repeated fertilization is particularly important for grains and for rape.

For the application of liquids it is necessary to drive portable field-spray equipment through the stands while applying liquids such as plant protection and pest control liquids as well as liquid fertilizers. The liquids to be applied therefore secure the quality of the yield and increase the volume of the yield.

The liquids must be applied in such a manner that no overdose is applied, nor should some of the areas be given an inadequate supply, lest the particularly sensitive parts of the plants be endangered.

Depending upon their grown height and their stage of development respectively, the plants are particularly sensitive at particular parts, to the active liquids. For instance, in grains and grasses at the top leaves and set-up crop, or at the green leaves of rape.

Other parts of these plants react indifferently, and there are observations to the effect that slight etching might even stimulate growth.

These facts point up the necessity of an application of liquids to such stands in a manner which will ascertain that the organs essential for the formation of the crop will not be injured.

It is known that a spray jet of liquid fertilizer may cause minor etching of the plant if it hits the plant with a low impact and in a careful manner.

Neither is it new that minor etching occurs whenever the liquid fertilizer is distributed in the form of coarse droplets. Whenever the spectrum of droplets emerging from the jets consists mostly of finer droplets, a markedly increased wetting is registered. In the case of fertilization with liquid fertilizer, one can observe extended damage to the plants. In order to achieve a distribution of coarser droplets, the so-called drop pipe was invented which is attached to the usual spray rods by connection pieces at a distance of one half meter and with total lengths of 10 to 20 meters. Usually, these drop pipes have 8 bores for each 50 cm, i.e. the droplet paths run in a distance of 6.25 m.

It is the disadvantage of this equipment that it is unwieldy in operation. It also happens relatively frequently that the drop pipes break; this applied in particular to the outside pipes whenever the rods sway, for instance, when turning around or driving in curves, or in an uneven terrain.

The idea suggests itself that the damage would be less whenever active liquids in lower concentrations are used. In the example described in the following, a ratio of 1:2.6 was used.

The spray angle out of the distributing equipment has a great influence on the localization of the major part of the liquid in various zones of the plants. The application of liquid fertilizer by means of distributing means which give the spray jet a horizontal flight path, cause greater etching than a vertically emerging jet.

Considering the above, fan jet nozzles were developed such as the nozzle 150/03 and nozzle 110/10. In this case, 150 or 110 respectively indicate the spray angle in angle degrees, while the numbers behind the slash indicate information by the manufacturer relating to the flow-rate. Given these characteristics, the fan jet nozzle 150/03 yields a spectrum of fine droplets, while the nozzle 110/10 has a size of droplets in the range of coarser drops.

The Flood Jet-nozzle provides an almost horizontally emerging jet of liquid. In this nozzle, the liquid hits a distributor disc after coming from a vertical bore. The improvement hoped for with the use of this nozzle, however, is limited inasmuch as the greater part of the liquid to be distributed comes to rest on the leafy roof of the stands. This causes damage. The less sensitive portions of the plants and those parts which, under certain circumstances would even profit from such damage, raising their yield and their quality, are hardly ever hit during the use of a Floodjet nozzle.

In the following table, the described nozzle systems are compared, using 60 kg N/ha in the form of AHL for the fertilization of autumn-sown wheat (Types: Diplomat, Disponent, Maris-Huntsman and Vuka) with a corresponding application of KAS prior to sowing. A classification (with grades 1=very good to 9=very bad) was made, and yields were observed. These were given as relative figures to the KAS-yield=100.

TABLE 1

| Test No. | Type | Classification | Yield % |
|---|---|---|---|
| 1 | KAS | 1.0 | 100 |
| 2 | Drop pipe (undiluted) | 1.0 | 93 |
| 3 | Drop pipe (diluted 1: 2.6) | 1.0 | 99 |
| 4 | Fanjet nozzle 150/03 | 2.5 | 95 |
| 5 | Fanjet nozzle 110/10 | 1.0 | 100 |
| 6 | Floodjet | 3.5 | 94 |

It has been shown that the depth of etching and the loss in yields are not parallel to each other. Thus, the Floodjet nozzle (6) in spite of rather high degrees of etching, yields higher yields than the drop pipe with an undiluted application of the AH - solution (2). On the other hand, yield losses have been observed when there were practically no damages by etching to be observed (see Test No. 2).

SUMMARY OF THE INVENTION

The final conclusion was arrived at that plant protection and pest control liquids and/or liquid fertilizer may be applied to stands of agricultural plantings without any damage to the yields, if this distribution is made with the aid of portable field spray equipment in connection with metering devices contained in distributor elements and drag hoses.

As mentioned before, the connection pieces in portable field-spray equipment usually have a distance of 50 cm from each other (in France, 37 cm). Given this distance, and the use of drag hoses, strips of the stands would remain without application. It is therefore, advisable to use enough drag hoses, that the distance is merely 25 cm, or 16.67 respectively, or 12.5 cm or 10 cm (measured from center to center).

In order to connect the drag hoses with the connection pieces of the portable field spray equipment, distributor elements containing metering devices are necessary. T or Y, or X pipe fittings or, in case a more wide-spread distribution is desirable, pipes in the shape of a spider or a rake, may be used for this purpose.

These pipes may be made of any material which cannot be corroded by the commonly used fertilizer liquids of the plant protection and pest control means, particularly of plastics and chrome-nickel steels.

The connection of these distributor means with the connection pieces of the spraying rods may be effected, depending on the material of the connection piece and of the distributor element, by welding, by screwing, by conical polished specimens with additional holding devices, by bushings, or by union nuts, by pieces of hose with collarbands or by any other means.

For the connection of the exit spouts of the distributor elements with the drag hoses, hose-spout connections and collar bands are preferred.

In this manner, the inlet and outlet of the distributor elements may be connected by identical as well as by differing means.

Additional stabilizers are necessary in order to maintain the equal distances between the drag hoses. Usually, one uses steel wires which, by being guided within, or, preferably, outside of these hoses, keep them at the desired distance. In a corresponding manner, it is possible to use spacers made of plastics which will remain rigid even with extreme outside temperatures.

Depending on the number of distribution points, the form of the distributor elements, and the surface characteristics of the field to be treated, provisions will be made to provide the metering devices either before the distributor element or before each outlet.

The common devices used for metering in such cases, such as valves, cocks, clamping devices, nozzles, etc. may be used. When using liquid fertilizers, grooved discs have proven to be very effective, since the flowrates in this case remain relatively great, so that there are no stoppages.

Under no circumstances must the ball valve filter usually built into the connection pieces of the portable rods be removed. If none should be provided, it is best to build one into the inlet spout of the distributor element, since otherwise frequent blockage would occur.

In any case, the distributor element gives the advantage that this necessary filter must be provided only once for two, three, four, or five, respectively, distributor points.

BRIEF DESCRIPTION OF THE DRAWINGS

The drawing shows a device in accordance with the invention, in the case of use of two drag hoses for each connection piece of the field-spray device.

DETAILED DESCRIPTION OF THE PREFERRED EMBODIMENTS

FIG. 1 shows a portion of the spray-bar with a connection piece (1). (2) shows the filtering device, fitted into the connection piece, and containing a freely moving sphere. The bushing (4) may be screwed to the connection piece of the spray equipment as well as to the inlet of the distributor element (5). The spouts (6) are screwed to the distributor element by means of union nuts (7). The hose (9) is pulled over the free ends of these spouts, and fastened by means of collar bands (8). The steel wire (10) is attached in such a manner that the free ends of the hose (not shown in this drawing) will remain at the pertinent desired constant distance from each other.

The grooved discs (3) used for metering are either inserted between the ball valve filter (2) and the bushing (4), or, in the alternative situation (3*a*), between the outlet spout of the distributor element (5) and the hose spout (6). A simultaneous use of metering discs in front and behind the distibutor element (5) is recommended for exceptional situations only, for instance, in a very uneven terrain. Generally, the arrangement of the metering device within the inlet to the distributor nozzle should suffice for an even distribution. The connection pieces between the field spray equipment and the distributor element as well as of the outlets of the distributor element and the connected hose, used for this example, may be replaced by the above discussed equivalents. The same applies to the metering device (3), or (3*a*) respectively, and the spacers (10) and, most of all, to the shape of the distributor element (5).

When using drag hoses in connection with this distributor element, we obtained the entirely surprising results that, while using AHL, for instance, the sensitive parts of the plants were not damaged. The liquid went immediately on, or into, the soil, without causing any etching, or etching the plants only in areas where this does not cause any damage to the yield of the crop. The fertilizing effect of the nourishing liquid introduced could be fully utilized, resulting not only in the fertilizing effect of DAS, but going above it in several cases. Using a hose placement of 25 cm, as an example, causing a corresponding high local concentration, no damage occurred even after the normal, sensible amounts of fertilizer were doubled. This is shown in the result obtained with fertilization of rape and pasture grass with Nitrate of ammonium-urea solution, compared with unfertilized test plots. (Table 2).

TABLE 2

| Application Variation | Kg/ha N | Rape* | Classification mean value of two testers | Pasture grass* | |
|---|---|---|---|---|---|
| without fertilizer | | 1.00± | 0 | 1.00± | 0 |
| Fanjet undiluted | 40 | 3.50± | 0 | 5.75± | 0.75 |
| | 70 | 5.00± | 0 | 6.25± | 0.75 |
| | 100 | 7.00± | 0 | 7.00± | 0.50 |
| | 140 | 7.50± | 0.5 | 7.75± | 0.25 |
| Fanjet nozzle 1:3 diluted | 40 | 4.75± | 0.25 | 6.00± | 0 |
| | 60 | 5.50± | 0 | 7.00± | 0 |
| Drag Hose undiluted | 40 | 1.50± | 0.50 | 2.75± | 0.25 |
| | 70 | 1.50± | 0.50 | 3.00± | 0 |
| | 100 | 1.50 | 0.50 | 3.25± | 0.25 |
| | 140 | 1.50 | 0.50 | 3.50± | 0.50 |

The procedure of the invention is at least equal in value to the proven procedure with KAS. This is shown in the average yields of autumn-sown wheat (from 6 locations) using KAS and AHL in amounts of 60 kg/N/ha, using various techniques of application.

TABLE 3

| Test No. | Kind | dt/ha | Yields in % |
|---|---|---|---|
| 1 | without fertilizer | 63.5 | 100 |
| 2 | KAS | 71.4 | 112 |
| 3 | Drop pipe | 67.5 | 107 |

TABLE 3-continued

| Test No. | Kind | dt/ha | Yields in % |
|---|---|---|---|
| 4 | Fanjet nozzle 110.06/08 | 67.4 | 107 |
| 5 | Drag Hose | 71.1 | 112 |

In this manner, it is possible to apply the advantageous liquid fertilizer in any desired amount independent of the vegetative stage of the plants or the weather conditions usually hindering the application, and doing it without risk or complicated rules of application which must be followed.

It was an additional, and quite unexpected result that the known spray rods in connection with the distributor elements, having nozzles, and with drag hoses, could be used without breakdowns and without technical complications even in high and dense stands of vegetation. The same is true for the use of portable spray equipment with pest control liquids.

It was also heretofore unknown that this procedure may not only be advantageous in use with advanced stages of growth, but that it may be used to advantage for the application of liquid fertilizer prior to the start of growth for grain and rape. During the spring fertilization of rape we observed that etchings, if at all, were unexpectedly minor. In general, they were less within the area of the fertilized stripe as compared to evenly wetting spray techniques. In this manner, this procedure offers a risk-free application of liquid fertilizer to rape. The procedure of this invention with all its advantages closes the gap in the possibilities of application of a liquid fertilizing system, namely, the fertilization of autumn-sown wheat and the fertilization of rape in the spring. No longer is the fear of damage and loss of yield when applying liquids to stands an obstacle for a general use of the portable field spray equipment, and, respectively, the application of plant protecting and pest control liquids and/or of liquid fertilizers to stands of agricultural growths such as grains, grasses and rape.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of spraying agricultural stands with a liquid, comprising the steps of:

supplying said liquid from a portable source of plant spray liquid, including a spray rod having apertures for liquids at 50 cm intervals to a distributor element connected to each of said apertures, at least one flexible drag hose connected at one end to each said distributor element, each said flexible drag hose having at least one nozzle adjacent the other end, said drag hoses having a length such that said other end of said drag hoses are free hanging at a point below the leafy rooves of said stands, and at least one metering device associated with each said distributor element; and feeding said liquid to said agricultural stands from said nozzles, whereby the leafy rooves of said stands are not damaged by said liquid.

2. The method of claim 1 wherein said liquid is plant protection and pest control liquid.

3. The method of claim 1 wherein said liquid is a liquid fertilizer.

4. The method of claim 1 wherein said liquid is an Ammonium Nitrate solution plus Urea.

5. The method of claim 1 wherein said plants are grains.

6. The method of claim 1 wherein said plants are pasture plants.

7. The method of claim 1 wherein said plants are rape plants.

8. A field spray apparatus for the application of liquids to plants in agricultural stands, comprising:

a portable source of plant spray liquid, including a spray rod having apertures for liquids at 50 cm intervals;

a distributor element connected to each of said apertures;

at least one flexible drag hose connected at one end to each said distributor element, each said flexible drag hose having at least one nozzle adjacent the other end, said drag hoses having a length such that said other end of said drag hoses are free hanging at a point below the leafy rooves of said stands; and at least one metering device associated with each said distributor element, whereby the leafy rooves of said stands are not damaged by said liquid.

9. The apparatus of claim 8 wherein said liquid is plant protection and pest control liquid.

10. The apparatus of claim 8 wherein said liquid is a liquid fertilizer.

11. The apparatus of claim 8 or 10 wherein said liquid is an Ammonium Nitrate solution plus Urea.

12. The apparatus of claim 8 wherein said plants are grains.

13. The apparatus of claim 8 wherein said plants are pasture plants.

14. The apparatus of claim 8 wherein said plants are rape plants.

15. The apparatus of claim 8 wherein each said at least one metering device is located at the connection between said spray rod and said at least one distributor element.

16. The apparatus of claim 8 wherein each said at least one metering device is located at the connection between said distributor element and each said at least one flexible drag hose.

17. The apparatus of claims 15 or 8 or 16 wherein said at least one metering device is a grooved disc.

18. The apparatus of claims 15 or 8 or 16 wherein said drag hoses include spacers for maintaining equal distance therebetween.

* * * * *